US012345511B1

(12) United States Patent
Kraft

(10) Patent No.: US 12,345,511 B1
(45) Date of Patent: Jul. 1, 2025

(54) SHOOTING COMPETITION SYSTEM AND METHODS OF MAKING AND USING SAME

(71) Applicant: Ward-Kraft, Inc., Fort Scott, KS (US)

(72) Inventor: Ryan Kraft, Fort Scott, KS (US)

(73) Assignee: Rekon, LLC, Pittsburg, KS (US)

( * ) Notice: Subject to any disclaimer, the term of this patent is extended or adjusted under 35 U.S.C. 154(b) by 716 days.

(21) Appl. No.: 17/241,622

(22) Filed: Apr. 27, 2021

Related U.S. Application Data

(60) Provisional application No. 63/015,938, filed on Apr. 27, 2020.

(51) Int. Cl.
*F41J 5/14* (2006.01)
*F41J 7/04* (2006.01)

(52) U.S. Cl.
CPC .. *F41J 5/14* (2013.01); *F41J 7/04* (2013.01)

(58) Field of Classification Search
CPC ..... F41J 5/14; F41J 7/04
See application file for complete search history.

(56) References Cited

U.S. PATENT DOCUMENTS 10,648,781 B1 * 5/2020 Behiel ..... F41A 33/00
2005/0098954 A1 * 5/2005 Stutz ..... F41J 7/04 273/390
2014/0367918 A1 * 12/2014 Mason ..... F41J 5/14 273/371
2016/0059136 A1 * 3/2016 Ferris ..... A63F 13/837 463/5
2016/0223298 A1 * 8/2016 Drahota ..... F41J 5/14
2016/0298930 A1 * 10/2016 Squire ..... F41G 3/2655
2021/0156652 A1 * 5/2021 Løkka ..... F41J 5/10

* cited by examiner

*Primary Examiner* — Robert P Bullington
*Assistant Examiner* — Stephen Alvesteffer
(74) *Attorney, Agent, or Firm* — AVEK IP, LLC

(57) ABSTRACT

A live ammunition shooting competition system comprises a target area having a first and a second set of targets for a first and a second shooter, respectively. The first set of targets and the second set of targets are arranged such that the first shooter can view a shooting progress of the second shooter as the first shooter shoots at the first set of targets and the second shooter can view a shooting progress of the first shooter as the second shooter shoots at the second set of targets. A first computing device is associated with the first shooter and a second computing device is associated with the second shooter. Each of the first computing device and the second computing device is configured to allow the first shooter and the second shooter to challenge shooters to a shooting competition and to negotiate a parameter for the shooting competition.

19 Claims, 8 Drawing Sheets

SHOOTING COMPETITION SYSTEM AND METHODS OF MAKING AND USING SAME

CROSS REFERENCE TO RELATED APPLICATIONS

This application claims priority to U.S. Provisional Application No. 63/015,938, filed on Apr. 27, 2020, the disclosure of which is incorporated by reference in its entirety herein.

FIELD OF THE DISCLOSURE

The disclosure relates generally to the field of shooting competition systems. More specifically, the disclosure relates to a software assisted target system for shooting competitions.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In an embodiment, a shooting competition system comprises an elevated target stand having a first set of targets configured to be targeted by a first shooter and a second set of targets configured to be targeted by a second shooter. The first set of targets comprises a plurality of first targets and a first finish line target. The second set of targets comprises a plurality of second targets and a second finish line target. The first set of targets and the second set of targets are arranged such that the first shooter can view a shooting progress of the second shooter as the first shooter shoots at the first set of targets and the second shooter can view a shooting progress of the first shooter as the second shooter shoots at the second set of targets. The system includes a first computing device associated with the first shooter and a second computing device associated with the second shooter. Each of the first computing device and the second computing device is configured to allow the first shooter and the second shooter to challenge shooters to a shooting competition and to select a parameter for the shooting competition. Each of the first computing device and the second computing device is configured to be automatically updated at an end of the shooting competition.

In another embodiment, a live ammunition shooting competition system has an elevated target stand comprising a first set of targets configured to be targeted by a first shooter and a second set of targets configured to be targeted by a second shooter. The first set of targets includes a plurality of first targets and a first finish line target. The second set of targets comprises a plurality of second targets and a second finish line target. The first set of targets and the second set of targets are arranged such that the first shooter can view a shooting progress of the second shooter as the first shooter shoots at the first set of targets and the second shooter can view a shooting progress of the first shooter as the second shooter shoots at the second set of targets. A first computing device is associated with the first shooter and a second computing device is associated with the second shooter. Each of the first computing device and the second computing device is configured to allow the first shooter and the second shooter to select a parameter for the shooting competition. The first finish line target and the second finish line target are collectively configured such that each of the first finish line target and the second finish line target falls when any one of the first finish line target and the second finish line target is struck.

A live ammunition shooting competition system comprises a target area having a first set of targets assigned to a first shooter and a second set of targets assigned to a second shooter. The first set of targets has a plurality of first targets and a first finish line target. The second set of targets comprises a plurality of second targets and a second finish line target. The first set of targets and the second set of targets are arranged such that the first shooter can view a shooting progress of the second shooter as the first shooter shoots at the first set of targets and the second shooter can view a shooting progress of the first shooter as the second shooter shoots at the second set of targets. A first computing device is associated with the first shooter and a second computing device is associated with the second shooter. Each of the first computing device and the second computing device is configured to allow the first shooter and the second shooter to challenge shooters to a shooting competition and to negotiate a parameter for the shooting competition. An indicator is configured to indicate an end of the shooting competition when one of the first finish line target and the second finish line target is struck.

BRIEF DESCRIPTION OF THE SEVERAL VIEWS OF THE DRAWINGS

Illustrative embodiments of the present disclosure are described in detail below with reference to the attached figures.

DETAILED DESCRIPTION

Figure 1:
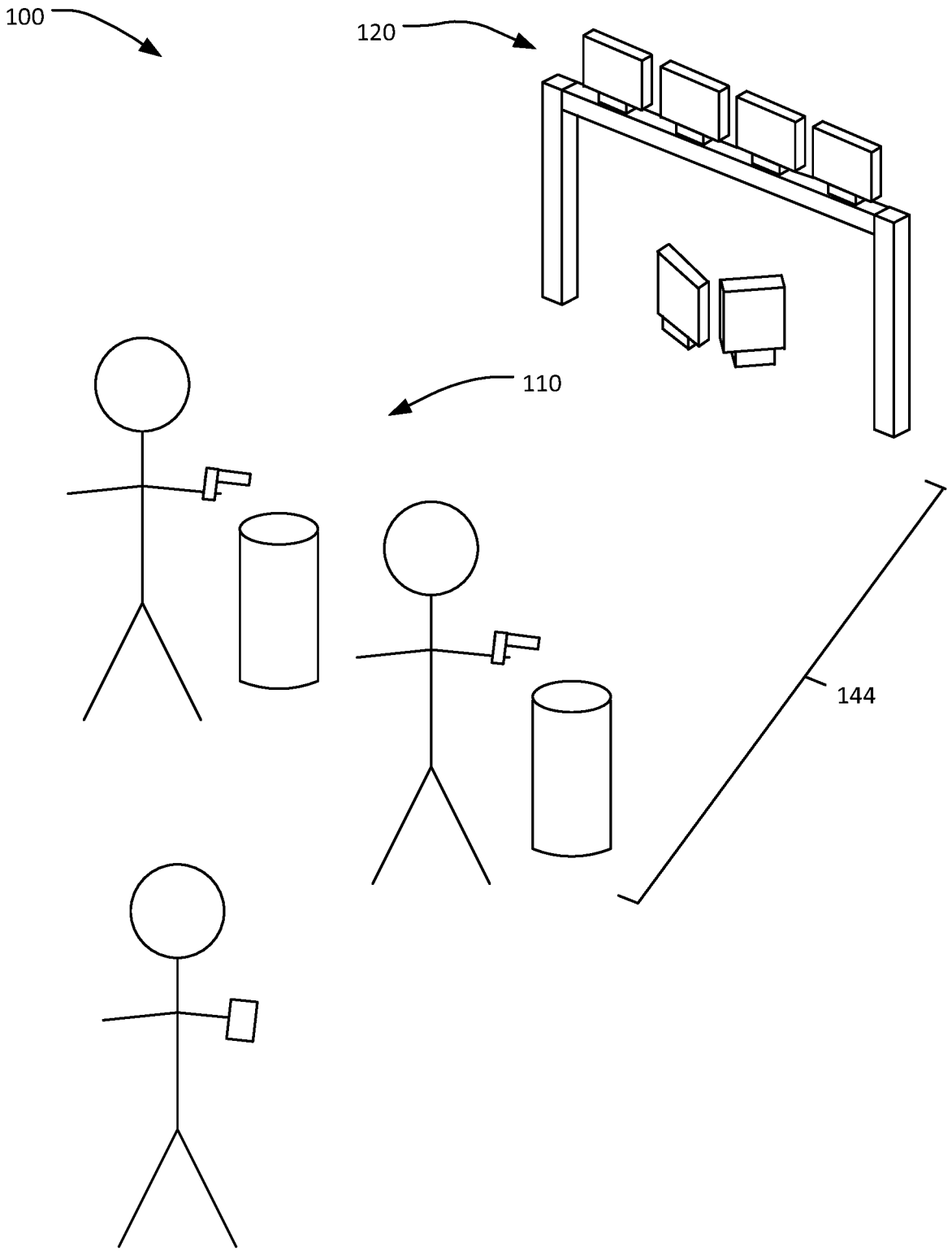
FIG. 1 is a perspective view of a shooting competition system, according to an embodiment of the present disclosure.
Figure 2:
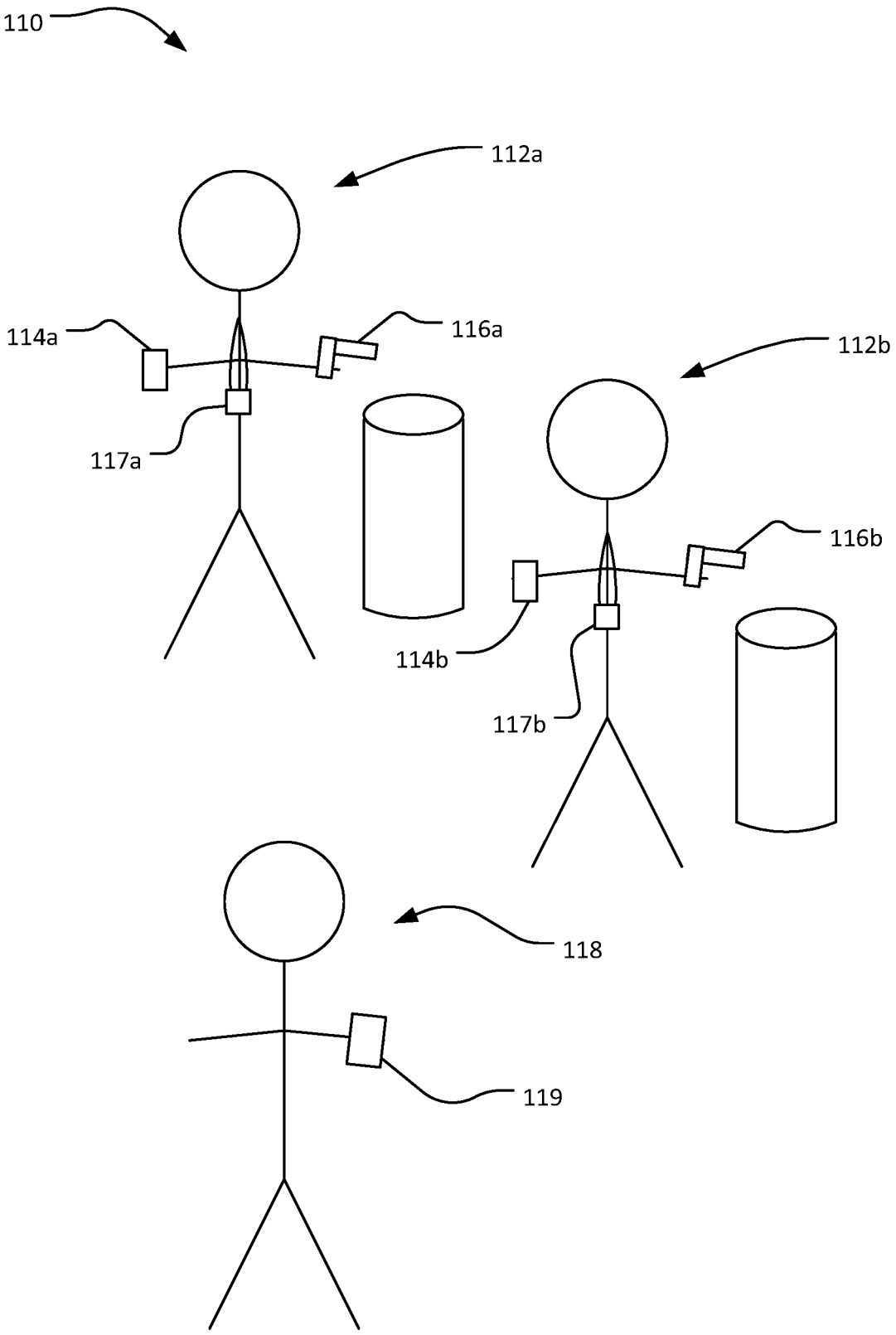
FIG. 2 is a schematic view of participants of the shooting competition system of FIG. 1.

An embodiment 100 of a shooting competition system may include participants 110 and a target station 120, as shown in FIGS. 1-2. In some embodiments, the shooting competition system 100 may utilize a computing system 130 (see FIG. 7). The shooting competition system 100 may allow one shooter (e.g., a participant 110) to compete with another shooter (e.g., another participant 110) based on one or more parameters that may be selected by the shooting system 100 and/or by an operator. In an embodiment, the winning participant may be the shooter that knocks down all the targets assigned to him or her before the other shooter (i.e., the competitor) knocks down all the targets assigned to the other shooter. In embodiments, the shooting competition system 100 may be set up such that: (a) both the participant and the competitor start shooting at their respective targets at the same time; and (b) the participant and the competitor take turns shooting at their assigned targets while the other observes. Or, the participant may start shooting at the participant's assigned targets before the competitor(s) starts shooting at the competitor's assigned targets, so long as the participant shoots at the participant's targets in view of the competitor, and vice versa. The shooters may use any suitable shooting apparatus (e.g., projectile launching, directed energy, etc.) now known or subsequently developed, such as a firearm, a bow, a crossbow, a BB gun, an airsoft gun, a paintball gun, a slingshot, an light or energy emitting device, et cetera. In embodiments, the shooting apparatus used by one participant 110 may be disparate from a shooting apparatus used by another participant 110. The shooting apparatus may be a live shooting apparatus (e.g., where the shooting apparatus is a gun, the gun may be configured to fire live ammunition, as opposed to, e.g., a gun usable in a laser tag game). The shooting apparatus may be configured to allow for a target to be physically contacted.

Conventional live shooting competition systems typically determine a winner amongst competitors by tracking the time each competitor takes to complete a shooting task (e.g., striking all assigned targets). These completion times may be adjusted by any relevant penalties and/or bonuses (e.g., the shooting time may be increased by a set amount when the shooter misses a shot, may be decreased by a set amount when the shooter shoots a bonus area, etc.) before the completion times are compared to determine a winner. Such conventional shooting competitions may have many drawbacks. The conventional shooting competitions may require each competitor to perform individually, i.e., without regard to the real-time shooting progress of other participants. Individual performances may be less exciting for both the competitor and for any audience wishing to spectate. Further, competitions requiring each participant to shoot at the participant's assigned targets without regard to the real-time progress of the competitors may fail to emulate practical real-world scenarios where a shooter's concentration may be divided between the shooter's shooting and someone and/or something else (e.g., a shooter shooting at a burglar for home defense may need to contend with the burglar's shooting at the same time).

The conventional shooting competitions may also have other shortcomings. Heretofore, the tracking, recording, and scoring of each competitor largely occurs manually, which is cumbersome (particularly when a large number of shooters is involved) and error prone. Moreover, the shooting competitions have no good way to pit comparable shooters against each other and/or to appropriately handicap shooters (e.g., by a giving a weaker shooter a gun that is relatively easier to operate and/or is more accurate), which may discourage competition. Embodiments of the shooting competition system 100 disclosed herein may remedy such issues at least in part.

The participants 110 may include a first competitor 112*a*, a second competitor 112*b*, and, in embodiments, a referee 118 (FIG. 2). The competitors 112*a*, 112*b* may compete by shooting at the target station 120 (FIGS. 4A and 4B), and the referee 118 may officiate the competitive match. While only two competitors and one referee are used to illustrate an exemplary embodiment of the shooting competition system 100, it is to be understood that the participants 110 may include more than two competitors, and more than one referee may officiate the match. In embodiments, a live referee may be omitted and the performance of the referee's functions may be automated.

Each competitor 112*a*, 112*b* may have his or her own electronic device 114*a*, 114*b* and a shooting apparatus 116*a*, 116*b* (e.g., firearm, bow, etc.) for use in the shooting competition system 100. The electronic devices 114*a*, 114*b* may be one or more smart phones, personal computers, computing systems 130 (see FIG. 7), or any other suitable electronic device. The electronic devices 114*a*, 114*b* may be used to facilitate the use of the shooting competition system 100 by the competitors 112*a*, 112*b*. For example, in embodiments, the electronic devices 114*a*, 114*b* may host a software application (e.g., software 131 shown in FIG. 7 and discussed below) configured to facilitate shooting competitions.

Figure 3:
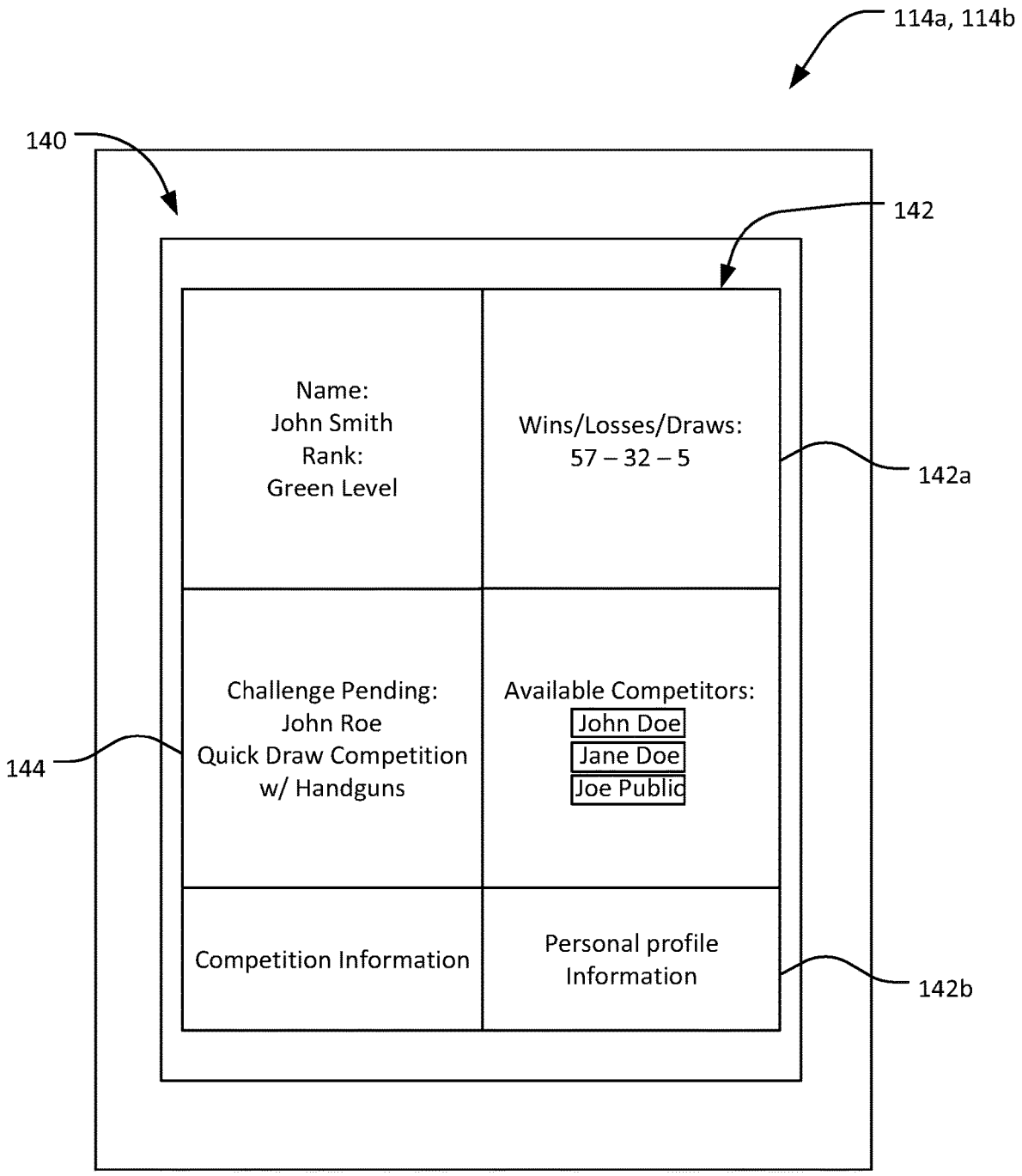
FIG. 3 is a schematic view of an electronic device displaying a user interface of a software application of the shooting competition system of FIG. 1.

FIG. 3 shows an exemplary user interface of a device 114*a*, 114*b* using the software application 131. The electronic devices 114*a*, 114*b* with the software application 131 may have or may have accessible thereto information involving shooting competitions, including, e.g., available shooting competitions, one or more competitor accounts 140, et cetera. Each participant 112*a*, 112*b* may have a unique account 140 associated with the shooting competition system 100.

The electronic devices 114*a*, 114*b* may be able to access personal account information 142 associated with the account 140 of each competitor 112*a*, 112*b*. The personal account information 142 may contain public information 142*a* corresponding to a competitor 112*a*, 112*b*, such as contact information, credentials, win/loss record, competitive statistics, competitive ranking (e.g., local, national, etc.), owned firearms, regional location, competitions attended, et cetera. Alternately or additionally, the personal account information 142 may contain private information 142*b* corresponding to a competitor 112*a*, 112*b*, such as contact information, account user name and password, credit/debit card information, address, et cetera. The public information 142*a* may be accessible to users (e.g., the competitors 112*a*, 112*b*, the referee 118, other users accessing the software 131, etc.), while the private information 142*b* may be inaccessible to most users. For instance, in embodiments, the private information 142*b* of an account 140 may be accessible only to an owner of the competitive account 140, an administrator of the software 131, and/or other users approved by the owner/administrator of the competitive account 140.

The competitors 112*a*, 112*b* may use the software application 131 on the electronic devices 114*a*, 114*b* to browse a list of other competitor accounts 140 along with the account information 142 corresponding to those competitors. The competitors 112*a*, 112*b* may use the competitor account information 142 to determine which, if any, of the competitors they wish to challenge. In embodiments, the competitors 112*a*, 112*b* may only be able to challenge shooters that are available to participate in a shooting competition (e.g., those that are at the assigned geographical location, those that have checked in, et cetera). The competitors 112*a*, 112*b* (who may otherwise be referred to as the "challenger") may then send a challenge (e.g., wired, wirelessly) to a competitor by selecting the competitor via a user interface of the electronic device 114*a*, 114*b* (e.g., a touch screen, mouse and keyboard, et cetera). The receiver of the challenge (who may be otherwise referred to as "the challengee") may then use the challangee's electronic device to choose whether to accept, decline, or ignore the challenge.

In embodiments, the competitors 112*a*, 112*b* may manually select terms for the challenge, such as parameters 144 (see FIG. 1 for an example distance-to-target parameter 144). The parameters 144 may include, for example, match rule sets, usable shooting apparatus 116*a*, 116*b*, handicaps (e.g., add/subtract number of targets to be hit, increase or decrease distance to targets, offset starting time, etc.) for one or both competitors, number of targets, types of targets, and/or any other parameter that may affect the outcome of the shooting competition. The parameters 144 may be set with an eye towards making the shooting competitions between the participants 110 (e.g., between the challenger and the challengee) closely competitive. In embodiments, the software 131 may evaluate the account information 142 from one or more competitor accounts 140 to determine or suggest one or more parameters 144. For example, the software 131 may use the personal account information 142 of the challenger and challengee to determine which shooting apparatus 116*a*, 116*b* are available for use. As another example, the software 131 may use the personal account information 142 of the challenger and the challengee to determine which competitor 112*a*, 112*b* is more skilled (e.g., by comparing competitor 112*a*, 112*b* win/loss record, statistics, recent wins/losses, winning/losing streaks, et cetera), and suggest a parameter that makes the competition relatively more difficult for that shooter. Or, for instance, the software 131 may suggest a shortened competitor-to-target distance for a competitor who has a win/loss ratio that is less than a win/loss ratio of his or her opponent. As another example, the software 131 may select a shooting apparatus 116*a*, 116*b* for a competitor 112*a*, 112*b* based in part on the statistics of that competitor 112*a*, 112*b* shooting with that shooting apparatus 116*a*, 116*b*. To illustrate, where the statistics show the competitor 112*b* is a more proficient shooter relative to the shooter 112*a*, the software 131 may give the competitor 112*a* an advantage by selecting for use a shooting apparatus 116*a* that the competitor 112*a* performs well with, wins matches with, and/or uses frequently. Alternately and/or in addition, the software 131 may give the competitor 112*b* a disadvantage by selecting for use a shooting apparatus 116*b* that the competitor 112*b* does not perform well with, loses matches with, uses infrequently, is more difficult to operate relative to the shooting apparatus 116*a*, et cetera. In embodiments, the software 131 may base a shooting apparatus 116*a*, 116*b* selection at least in part on other match parameters 144, such as the number and/or types of the targets, the distance to the targets, et cetera. For example, the software 131 may give competitor 112*b* a disadvantage by selecting for competitor 112*b* a short ranged and/or harder to aim shooting apparatus 116*b* where the distance between the targets and the participants is large.

Figure 5:
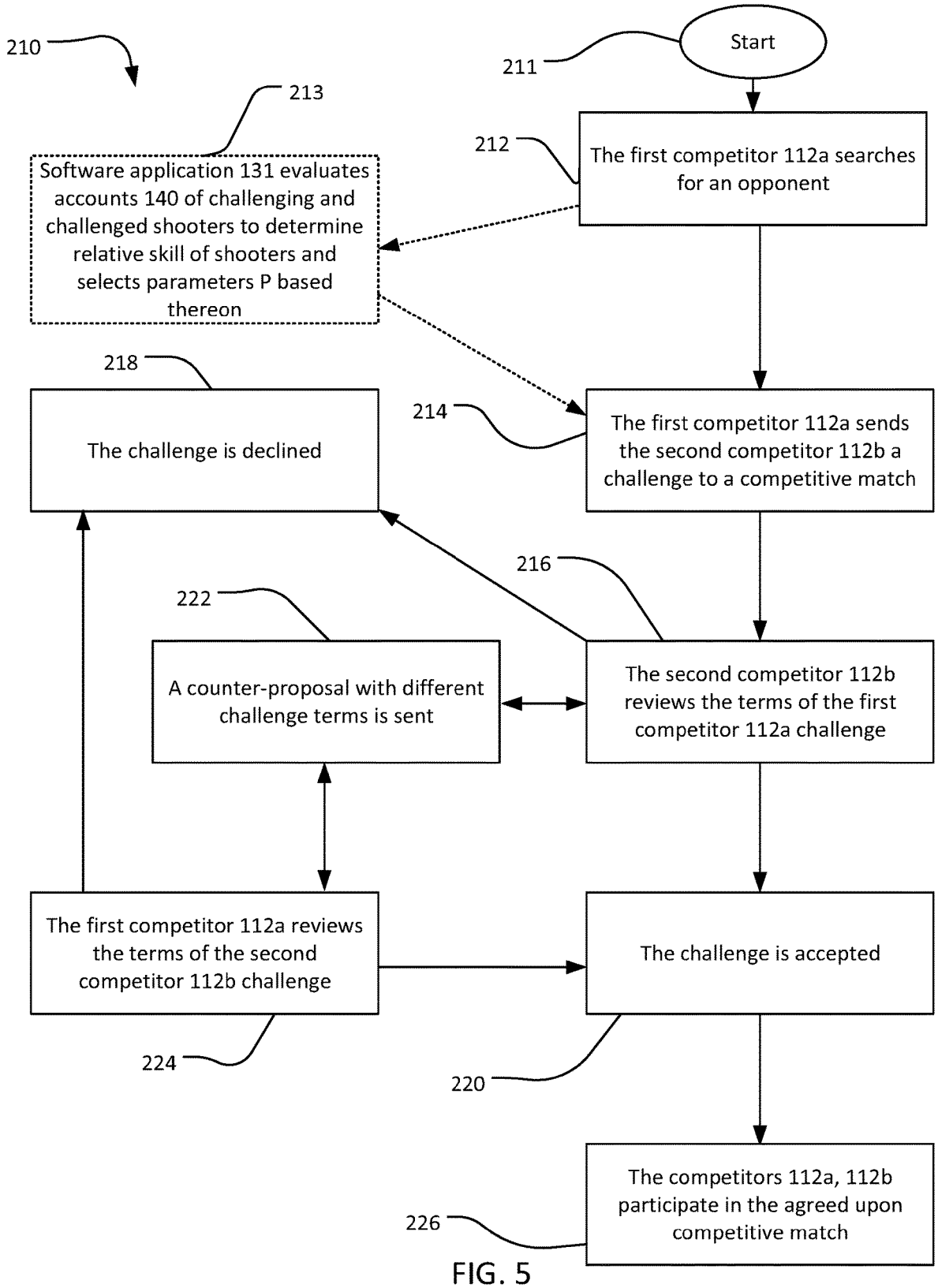
FIG. 5 is a flowchart depicting a method of arranging a competitive match challenge of the shooting competition of FIG. 1.

FIG. 5 shows an example method 210 of setting up a competitive match using electronic device 114*a*, 114*b*. The method 210 may start at step 211, and at step 212, the first competitor 112*a* may browse the software application on his or her electronic device 114*a* and find the information corresponding to the second competitor 112*b*. Then, at step 214, the first competitor 112*a* may review the account information of the second competitor 112*b* and determine (e.g., based on comparing win/loss records) that the second competitor 112*b* is less skilled, and so the first competitor 112*a* may send the second competitor 112*b* a challenge with parameters 144 (e.g., competing with rifles as shooting apparatus 116*a*, 116*b*) geared towards evening out the skill disparity so the shooting competition is closely competitive. Then, at step 216 the second competitor 112*b* may receive the first competitor's 112*a* challenge on the electronic device 114*b* for review. The second competitor 112*b* may decline the challenge (at step 218), accept the challenge (at step 220), or counter-challenge with modified parameters 144 (at step 222). For example, the second competitor 112*b* may determine the currently proposed parameters 144 would not sufficiently address the skill disparity, and so the second competitor 112*b* may counter-propose with different challenge parameters 144 (e.g., by saying he or she would compete using a rifle only if the first competitor 112*a* uses a handgun). Then, at step 224, the first competitor 112*a* may review the proposed terms of the challenge and may similarly decline (at step 218), accept (at step 220), or renegotiate the parameters 144 of the challenge (at step 222). The negotiations about the parameters 144 may go back and forth in this manner until the challenge is accepted and both participants have agreed to the terms of the challenge. Then, at step 226, the competitors 112*a*, 112*b* may participate in the competitive match using the agreed upon parameters 144. While the method 210 is illustrated using two shooters, the artisan will understand that any number of shooters may employ the method 210 to set up a competitive match therebetween.

It shall be understood that the method 210 may have steps omitted, added, and/or modified, and that the order of carrying out these steps may be altered. For example, in embodiments, a competitor may be only able to accept or decline a challenge, and may not be allowed to change or suggest changes to the competition parameters 144. As another example, the referee 118 may, in embodiments, select the competitors 112*a*, 112*b* and/or parameters 144 for the competitive match (e.g., in addition to the competitor 112*a*, 112*b* input, overruling competitor 112*a*, 112*b* input, et cetera).

In embodiments, the first competitor 112*a* may select the opponent. In other embodiments, the opponent may be selected by the software application 131. Similarly, in embodiments, the parameters for the challenge may be chosen by software application 131, as shown in optional step 213. For example, in embodiments, after the first competitor searches for (and/or selects) an opponent at step 212, the software application 131 may determine the parameters P for the challenge based on the relative skill of the first competitor/challenger 112*a* and the challenge 112*b*. For example, in embodiments, the software 131 may review the respective accounts 140 of the shooters 112*a*, 112*b*, determine from their win/loss accounts that the first shooter 112*a* is more skilled than the second shooter 112*b*, and consequently, set a handicap in the parameters P to encourage a more competitive challenge (e.g., allow the second shooter 112*b* to participate with a gun that is relatively easier to operate, reduce the distance to target of the second shooter 112*b*, reduce the number of targets the second shooter 112*b* has to hit compared to the first shooter 112*a*, select for the challenge the type of firearm favored by the second shooter 112*b*, and so on).

The referee 118 may use a referee electronic device 119 (e.g., a smart phone, tablet, personal computer, desktop computer, computing system 130, etc.) to assist with officiating one or more competitive matches. The referee device 119 may host the previously described software 131 application with modified capabilities (e.g., moderator/administrator privileges). For example, the referee device 119 may display participant 110 rankings, a queue for participant 110 accepted challenges, participant 110 personal account information 142, et cetera. In operation, the referee 118 may use the referee device 119 with the software 131 application to organize, run, and record the competitive matches.

The results of the competitive matches may be entered (e.g., manually, automatically) via the referee electronic device 119. The referee 118 may visually determine a winner (as discussed in greater detail below), and record the results. For instance, the referee 118 may select the winner from a list of the participants 110, select a picture of the winner displayed on the referee device 119, manually enter the winner via the referee device 119, et cetera. In an embodiment, the target station 120 may automatically determine the winner and communicate (e.g., wired, wirelessly) the results to the referee device 119 or elsewhere.

In embodiments, the competitors 112*a*, 112*b* may each have a competitor identifier 117*a*, 117*b* (FIG. 2). Each of the competitor identifiers 117*a*, 117*b* may be associated with a competitor 112*a*, 112*b* (e.g., linked to their personal account information 142) and may be used to facilitate a competitive match. For example, the competitor identifiers 117*a*, 117*b* may include indicia (e.g., a numeric identifier, an account username, a code, an RFID tag, a barcode, other machine-readable indicia, etc.) that is associated with their competitor account 140 and/or account information 142. The competitor identifiers 117*a*, 117*b* may be on the electronic devices 114*a*, 114*b* (e.g., shown on a display thereof), a tag, a card, a badge, apparel containing machine readable indicia, and/or any other suitable identifier medium. In operation, the competitor identifiers 117*a*, 117*b* may be used to identify competitors 112*a*, 112*b*, access account information of competitor 112*a*, 112*b*, update account information competitor 112*a*, 112*b* (e.g., scan/enter the competitor identifier 117*a*, 117*b* to register a win/loss), et cetera.

Figure 4A:
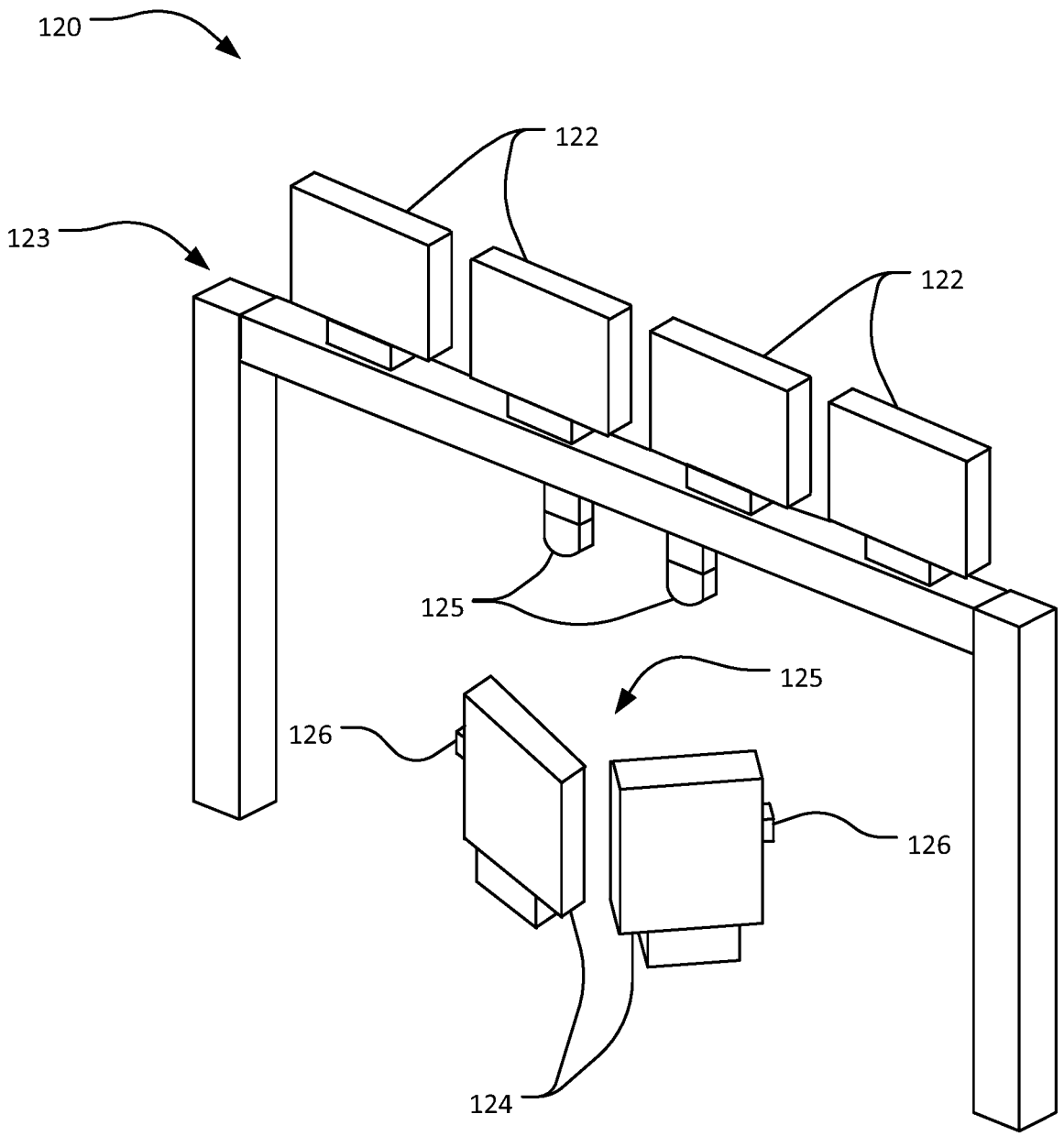
FIG. 4A is a perspective view of a target station of the shooting competition system of FIG. 1, with targets in a set-up state.

Turning now to FIG. 4A, the target station 120, shown here in a set-up configuration, may include targets 122 and finish line targets 124. In operation, the target station 120 may be used by the participants 110 to participate in a shooting competition. The target station 120 may be a target station designed for use with the shooting competition system 100, though in embodiments the target station 120 may be a conventional target station retrofitted for use with the shooting competition system 100 (e.g., a conventional target station used with the software application 131).

The target station 120 may include one or more targets 122 that may be any suitable shooting targets of any size, shape, color, and/or configuration now known or subsequently developed. For instance, in embodiments, the targets 122 may be targets configured to indicate (e.g., visually) hits upon the target 122, such as a swivel targets (e.g., hinged targets), reactive targets, splatter targets, destructible targets (e.g., sporting clays), and/or any other suitable target type. Alternately or additionally, the targets 122 may be configured for use with a specific shooting apparatus 116*a*, 116*b* and/or specific competitive match parameters 144. For example, using swivel targets as targets 122 may be beneficial when the shooting apparatus 116*a*, 116*b* are firearms and the competitive match parameters include a large distance between the targets and the competitors 112*a*, 112*b*. As another example, using standard archery targets as targets 122 may be beneficial when bow and arrows are being used as shooting apparatus 116*a*, 116*b*. To provide support to the targets 122, the targets 122 may be arranged in, on, and/or around a target stand (or target area) 123. The target stand may be elevated (e.g., may be at a vertical distance from the ground). To emulate real-world scenarios, the target stand 123 (e.g., a post, a pole, a fence, a frame, other area (e.g., a floor or a wall), et cetera) may be configured to allow the targets 122 to be situated such that each competitor can view the shooting progress of all competitors during the competition. For example, a space between two adjacent targets of the first competitor 112*a* may be the same as the space between a target of the first competitor 112*a* and an adjacent target of the second competitor 112*b*. In operation, the competitors 112*a*, 112*b* may compete by shooting the targets 122 with their shooting apparatus 116*a*, 116*b*.

A set of targets 122, having any suitable number of targets (e.g., 1, 2, 3, 5, 10, etc.), may be provided for each competitor 112*a*, 112*b* to shoot. Each set of targets 122 may be explicitly assigned to each competitor 112*a*, 112*b* (e.g., by having different colors, shapes, markers, etc.) and/or implicitly assigned to each competitor 112*a*, 112*b* (e.g., by being arranged in an area in front of the respective competitor 112*a* or 112*b*, having a dividing line between the assigned targets, et cetera). In embodiments, the sets of targets 122 may have a mirrored arrangement (e.g., a mirrored arrangement about a center of the stand 123 and/or the target station 120). Alternately, each competitor 112*a*, 112*b* may have an identically arranged set of targets 122. In embodiments, the sets of targets 122 may differ in number and/or arrangement from each other. For instance, the parameters 144 of a challenge may include a different arrangement/number of targets 122 between the competitors 112*a*, 112*b* to increase or decrease the difficulty of the challenge.

Figure 4B:
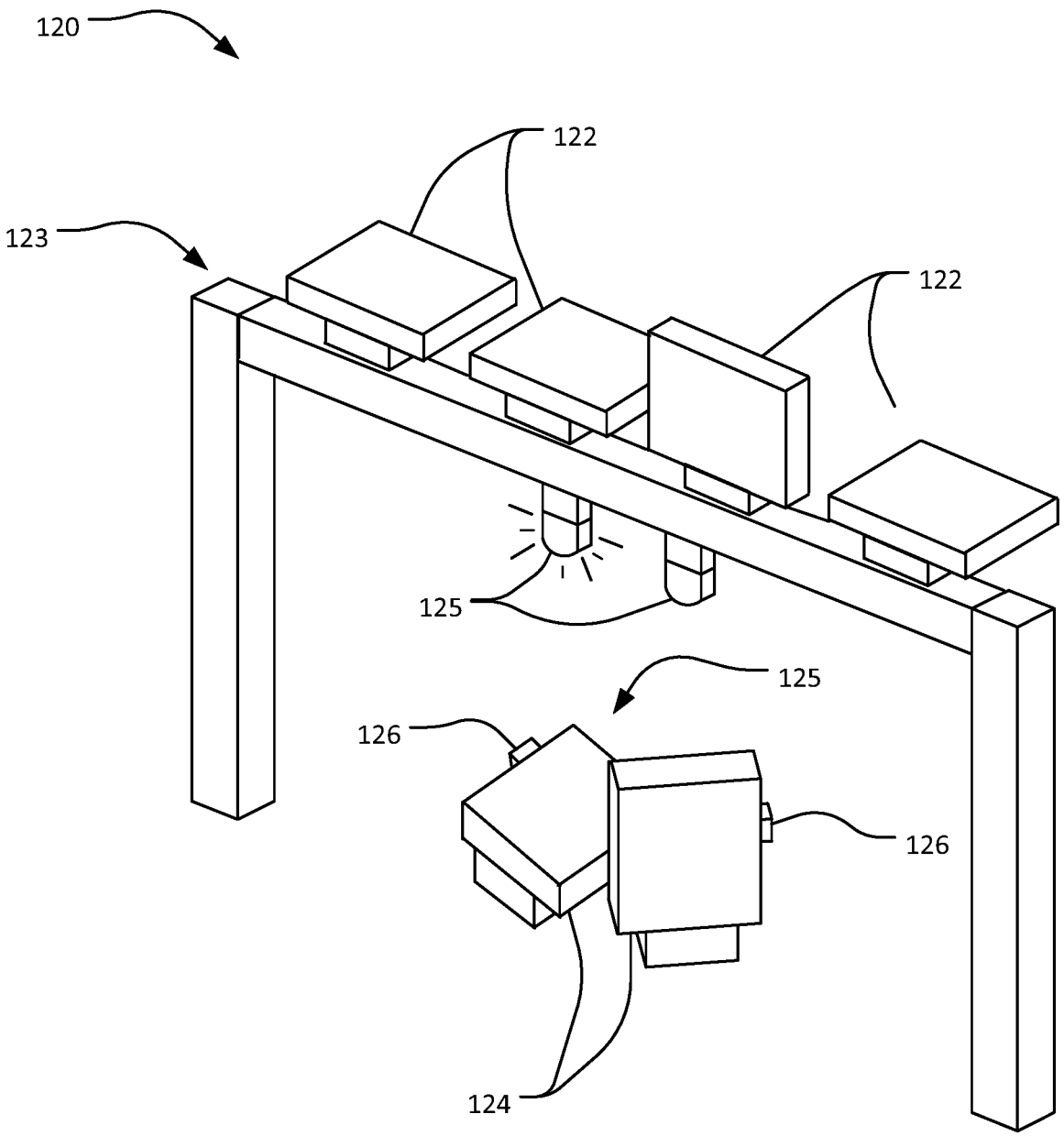
FIG. 4B is a perspective view of the target station of the shooting competition system of FIG. 1, with targets in a knocked-down state.

The finish line targets 124 may have the same or similar target types as the targets 122, and each competitor 112*a*, 112*b* may be assigned a solitary finish line target 122. In other words, each competitor 112*a*, 112*b* may have a finish line target 124 to hit after the competitor has hit all of the competitor's other targets 122. Alternately, in some embodiments, the targets 122 may be omitted, and each competitor 112*a*, 112*b* may have only a finish line target 124 to hit (e.g., for a quickdraw competition). In embodiments, the finish line targets 124 may be distinct (e.g., visually distinct) from the targets 122, such as have a different shape, color, size, arrangement, et cetera. In operation, the finish line targets 124 may be the last of the targets to be hit (e.g., after all of the targets 122 have been hit) by the competitors 112*a*, 112*b*, and whoever hits their assigned finish line target 124 first may be determined the winner. FIG. 4B depicts an example of a finish line target 124 in a knocked-down state. In this case, the two left side hinged targets 122 were knocked down so that the competitor 112*a*, 112*b* assigned to those targets 122 was able hit their finish line target 124. The competitor 112*a*, 112*b* assigned to the targets 122 on the right side had hit only one target 122 in this instance.

To assist with determining the winner, the finish line targets 124 may have one or more indicators 125 disposed thereon and/or otherwise associated therewith. The indicator 125 may signal which of the finish line targets 124 has been hit, and thus may assist with determining who has won the competitive match. For example, the indicator 125 may be a mechanical flag (e.g., a spring-loaded flag) corresponding to each finish line target 124 that is configured to spring up in response to its corresponding finish line target 124 being hit or otherwise shot. As another example, the indicator 125 may be a light (e.g., an LED, an electronic display, a light bulb, etc.) for each finish line target 124 that is configured to emit light in response to its corresponding finish line target 124 being hit. As yet another example, the indicator 125 may be an arrangement of the finish line targets 124, such as an angled or non-parallel placement between two or more swivel finish line targets 124. The angled placement of finish line targets 124 may allow the finish line targets 124 to overlap each other once they have both been hit, thereby indicating a winner (i.e., the first finish line target 124 to be hit will fall over first, and thus will be beneath any other subsequently knocked over finish line targets 124; alternately, the first finish line target 124 to be hit may fall and cause the other finish line target(s) 124 to fall along therewith, and thereby be atop the other fallen target(s)). FIG. 4B depicts an example of activated indicators 125 corresponding to a finish line target 124 hit, including both an activated light indicator and an angled finish line target 124 in a knocked-down state.

In embodiments, the finish line targets 124 may be configured to communicate a hit to one or more other finish line targets 124. For instance, two or more finish line targets 124 may be physically linked such that a first finish line target 124 may communicate a hit registered on the first finish line target to a second finish line target 124. Alternately or additionally, two or more finish line targets 124 may be electronically linked (e.g., wired and/or wirelessly) for the communication of hits therebetween. In response to the communicated hit from the first finish line target 124, the second finish line target 124 may mark itself as unavailable to be hit for a competitive match win. For example, the second finish line target 124 may respond to the hit communication by falling over, changing a color of the second finish line target 124, emitting an audio/visual cue (e.g., a siren and/or a light), et cetera.

In embodiments, the finish line targets 124 may include one or more sensors 126. The sensors 126 may be any suitable sensors for detecting a target hit, such as an optical sensor (e.g., a camera, a photodetector, etc.), a motion sensor (e.g. a radar sensor, an ultrasonic detector, etc.), and/or a vibrational sensor (e.g., a potentiometric accelerometer, an eddy current sensor, an electromagnetic linear velocity transducer, et cetera). The sensors 126 may be arranged on, in, and/or around the finish line targets 124. For example, the sensors 126 may be attached to the finish line targets 124, incorporated within the finish line targets 124, removably attached to the finish line target 124 via a mechanism (e.g., adhesive, a pouch, fasteners, etc.), and/or placed within a proximity (e.g., a sensing range) of the finish line targets 124. In operation, the sensors 126 may assist with detecting a hit on the finish line targets 124, such as detecting which finish line target 124 was hit and/or when the finish line target 124 was hit. Alternately or additionally, one or more sensors 126 may be used to assist with a hit detection of one or more targets 122.

In embodiments, the sensors 126 may be communicatively linked (e.g., wired and/or wirelessly) to the indicators 125 and/or the referee device 119. For example, the sensors 126 may detect a hit on one of the finish line targets 124, and may then communicate the hit detection to the indicator 125 and the referee device 119. The indicator 125 may respond to the hit detection by visually indicating which finish line target 124 was hit (e.g., via emitting a light). And the referee device 119 may register a winner of the competitive match by linking (e.g., automatically, manually via the referee 118) the received hit detection with the corresponding competitor 112*a* or competitor 112*b*, and modifying their personal competitor account information 142 accordingly.

In embodiments, a hit registered by a sensor 126 of a finish line target 124 may prevent the indication of a hit registered by another sensor 126 of a different finish line target 124. For instance, in a situation where a first finish line target 124 is hit and then a second finish line target 124 is subsequently hit, the sensor 126 of the first finish line target 124 may trigger the indicator 125 for the first finish line target 124. However, the sensor 126 of the first finish line target 124 may be configured to prevent the indicator 125 of the second finish line target 124 from being triggered after the registration of the first hit. Alternately or additionally, the subsequent hit detection by the sensor 126 may not be communicated to the referee device 119. In other words, hits subsequent the first hit may not trigger the indicators 125, be communicated to the referee device 119, and/or otherwise be used to determine a winner of the competitive match. For example, from the viewpoint of the competitors 112*a*, 112*b*, whoever hit his or her finish line target 124 first may be the only competitor to have the indicator 125 of their respective target triggered, and thus determination of the winner may be relatively easy to accomplish.

Figure 6:
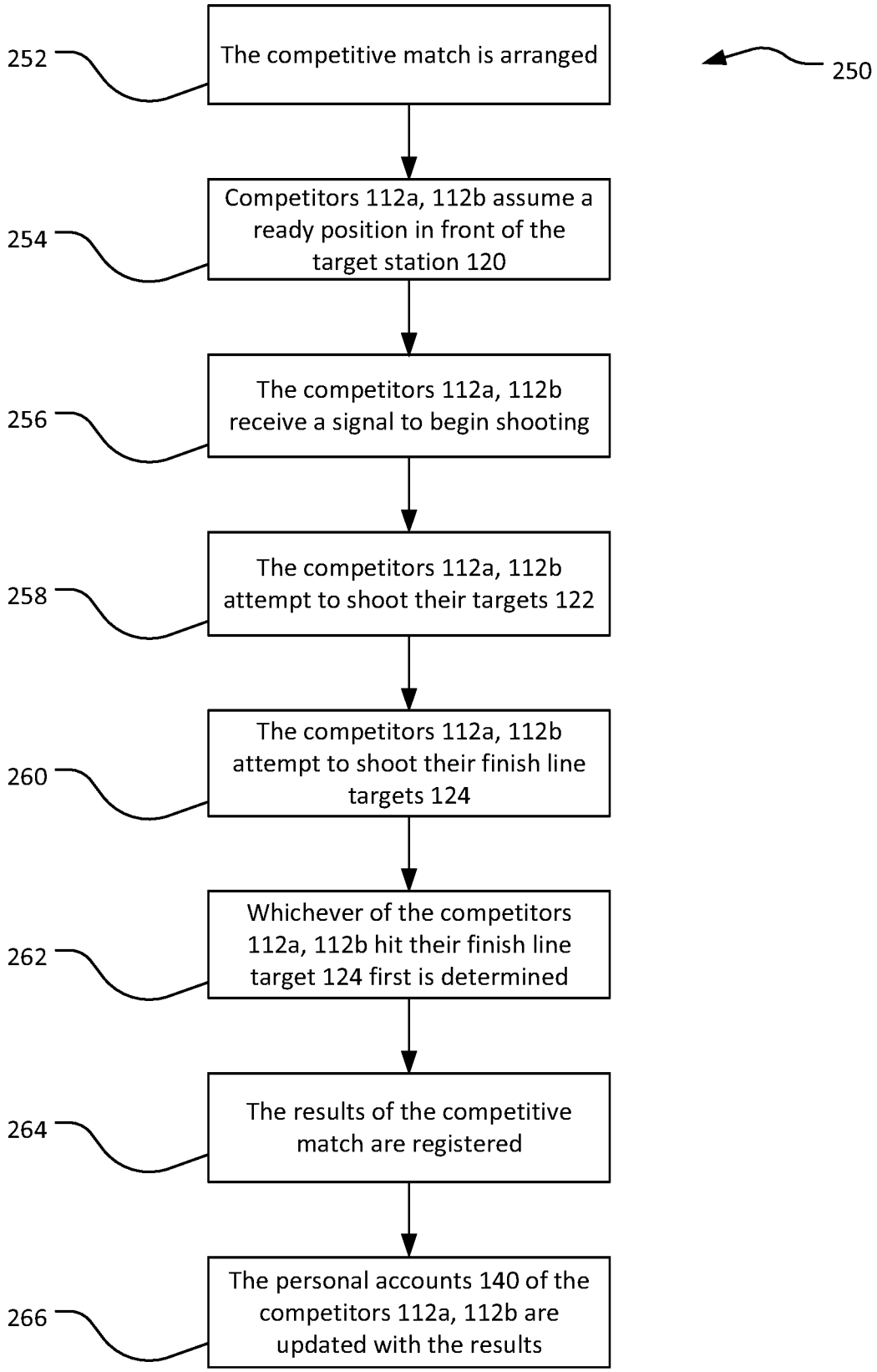
FIG. 6 is a flowchart depicting a method of operating the target station of the shooting competition system of FIG. 1

For illustrative purposes, the following example method 250 of performing the competitive match with the shooting competition system 100 is presented in FIG. 6. First, at step 252, the competitive match may be arranged and the match parameters 144 may be determined, such as through competitor 112*a*, 112*b* challenges as previously described in method 210. Then, at step 254, competitors 112*a*, 112*b* may assume a ready position across from the target station 120 (e.g., the targets 122 and the finish line targets 124). Next, at step 256, the competitors 112*a*, 112*b* may receive a signal to begin shooting, such as a visual and/or audio signal from the referee 118 and/or the referee device 119. The competitors may then, at step 258, attempt to shoot their assigned targets 122. Once a competitor 112*a*, 112*b* has hit their assigned targets 122, then at step 260, that competitor 112*a*, 112*b* may attempt to shoot their assigned finish line target 124. At step 262, whichever competitor 112*a*, 112*b* hit their finish line target 124 first may be determined via the methods described above (e.g., via an indication from the indicator 125, a detection by the sensors 126, an overlap of the finish line targets 124, et cetera). Next, at step 264, the winner of the competitive match may be registered, such as via manual input through the referee device 119, an automatic input (e.g., a wired/wireless communication from the sensors 126), et cetera. Finally, at step 266, the personal account 140 of one or more of the competitors 112*a*, 112*b* may be updated accordingly. For example, the winner of the competitive match may be assigned a victory in their personal account information 142 and the loser may have a defeat assigned to their personal account information 142, as discussed above. Other data, e.g., the shooting apparatus, distance to target, the time to completion, information about match competitiveness, et cetera, may likewise be stored as personal account information 142.

It shall be further understood that the method 250 may have steps omitted, added, and/or modified, and that the order of carrying out these steps may be altered. For example, in embodiments, the step of attempting to shoot the targets 122 (step 258) may be omitted for specific competitive match terms, such as in a quickdraw competitions where only the finish line target 124 needs to be hit.

Figure 7:
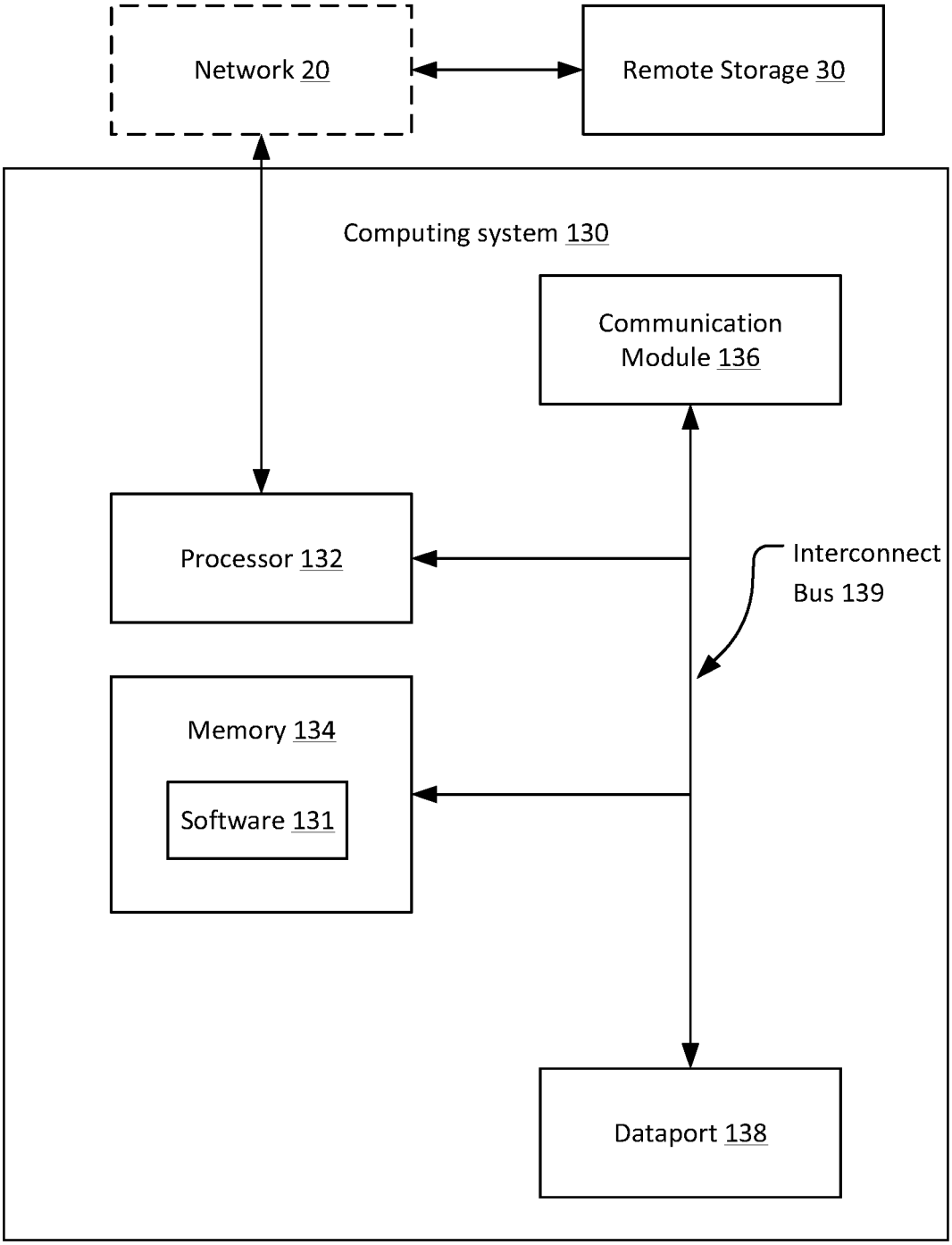
FIG. 7 is a block diagram depicting a computing system of the shooting competition system of FIG. 1.

FIG. 7 is a functional block diagram of the computing system 130 which may be used to implement (e.g., by being incorporated with the competitor electronic devices 114*a*, 114*b* and/or the referee device 119) the various shooting competition system embodiments according to the different aspects of the present disclosure. The computing system 130 may be, for example, a smartphone, a laptop computer, a desktop computer, a flexible circuit board, or other computing device whether now known or subsequently developed. The computing system 130 may include a processor 132, a memory 134, a communication module 136, and a dataport 138. These components may be communicatively coupled together by an interconnect bus 139. The processor 132 may include any processor used in smartphones and/or other computing devices, including an analog processor (e.g., a Nano carbon-based processor). In certain embodiments, the processor 132 may include one or more other processors, such as one or more microprocessors, and/or one or more supplementary co-processors, such as math co-processors.

The memory 134 may include both operating memory, such as random access memory (RAM), as well as data storage, such as read-only memory (ROM), hard drives, optical, flash memory, or any other suitable memory/storage element. The memory 134 may include removable memory elements, such as a CompactFlash card, a MultiMediaCard (MMC), and/or a Secure Digital (SD) card. In certain embodiments, the memory 134 includes a combination of magnetic, optical, and/or semiconductor memory, and may include, for example, RAM, ROM, flash drive, and/or a hard disk or drive. The processor 132 and the memory 134 each may be located entirely within a single device, or may be connected to each other by a communication medium, such as a USB port, a serial port cable, a coaxial cable, an Ethernet-type cable, a telephone line, a radio frequency transceiver, or other similar wireless or wired medium or combination of the foregoing. For example, the processor 132 may be connected to the memory 134 via the dataport 138.

The communication module 136 may be configured to handle communication links between the computing system 130 and other external devices or receivers and to route incoming/outgoing data appropriately. For example, inbound data from the dataport 138 may be routed through the communication module 136 before being directed to the processor 132, and outbound data from the processor 132 may be routed through the communication module 136 before being directed to the dataport 138. As another example, the communication module 136 may route information to/from the competitor electronic devices 114*a*, 114*b*, sensors 126, and/or the referee electronic device 119. The communication module 136 may include one or more transceiver modules configured for transmitting and receiving data, and using, for example, one or more protocols and/or technologies, such as Bluetooth, GSM, UMTS (3GSM), IS-95 (CDMA one), IS-2000 (CDMA 2000), LTE, FDMA, TDMA, W-CDMA, CDMA, OFDMA, Wi-Fi, WiMAX, or any other protocol and/or technology.

The dataport 138 may be any type of connector used for physically interfacing with a smartphone, computer, and/or other devices, such as a mini-USB/USB port, an IPHONE®/IPOD® 30-pin connector, and/or LIGHTNING® connector. In other embodiments, the dataport 138 may include multiple communication channels for simultaneous communication with, for example, other processors, servers, and/or client terminals.

The memory 134 may store instructions for communicating with other systems, such as a computer. The memory 134 may store, for example, a program (e.g., computer program code) adapted to direct the processor 132 in accordance with the embodiments described herein. The instructions also may include program elements, such as an operating system. While execution of sequences of instructions in the program causes the processor 132 to perform the process steps described herein, hard-wired circuitry may be used in place of, or in combination with, software/firmware instructions for implementation of the processes of the present embodiments. Thus, unless expressly noted, the present embodiments are not limited to any specific combination of hardware and software.

In embodiments, the memory 134 includes software 131. The software 131 may contain machine-readable instructions (e.g., a software application as described above) configured to be executed by the processor 132. The software 131 may, for example, process user inputs to the computing system 130 (e.g., competitor 112*a*, 112*b* challenges, competitive match results, et cetera). The software 131 may cause the computing system 130 to dynamically respond to a signal from the sensors 126, such as by determining a winner from amongst the competitors 112*a*, 112*b* and modifying the personal account information of the competitors 112*a*, 112*b* accordingly. In embodiments, a computing device (e.g., the competitor electronic devices 114*a*, 114*b*, the referee electronic device 119, etc.) may implement (e.g., download, install, execute, etc.) the software 131, and in this manner be configured to enact the functions of the shooting competition system 100 disclosed herein. In other words, the computing device may be configured, retrofitted, and/or reconfigured with the software 131, for use with the shooting competition system 100.

The computing system 130 may be in data communication with a remote storage 30 over a network 20. The network 20 may be a wired network, a wireless network, or comprise elements of both. The remote storage 30 may be, for example, the "cloud" or other remote storage in communication with other computing systems. In embodiments, data (e.g., competitor 112*a*, 112*b* accounts 140 and account information 142) may be stored in the remote storage 30 for use thereof.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations and are contemplated within the scope of the claims. Not all steps listed in the various figures need be carried out in the specific order described.

The claims are amended as follows:

1. A live ammunition shooting competition system, comprising:

an elevated target stand comprising a first set of targets configured to be targeted by a first shooter and a second set of targets configured to be targeted by a second shooter, said first set of targets comprising a plurality of first targets and a distinct first finish line target, said second set of targets comprising a plurality of second targets and a distinct second finish line target, said first set of targets and said second set of targets being arranged such that said first shooter can view a shooting progress of said second shooter as said first shooter shoots at said first set of targets and said second shooter can view a shooting progress of said first shooter as said second shooter shoots at said second set of targets;

a first computing device associated with said first shooter and a second computing device associated with said second shooter, each of said first computing device and said second computing device configured to allow said first shooter and said second shooter to issue a challenge to shooters for a shooting competition and to set a plurality of parameters for said shooting competition; and an indicator configured to indicate an end of said shooting competition when any one of said first finish line target and said second finish line target is struck;

wherein;

said plurality of parameters are selected automatically by one of said first computing device and said second computing device based on a comparison of a skill of said first shooter and a skill of said second shooter; and said plurality of parameters include a match rule set of the shooting competition, the shooting apparatus available for use in the shooting competition, distance from the first shooter to the first set of targets, and distance from the second shooter to the second set of targets.

2. The live ammunition shooting competition system of claim 1, wherein said parameter dictates that said first shooter and said second shooter use firearms of a disparate type.

3. The live ammunition shooting competition system of claim 1, further comprising a first identifier for said first shooter and a second identifier for said second shooter, each of said first identifier and said second identifier being configured to be machine readable.

4. The live ammunition shooting competition system of claim 1, wherein said indicator is wirelessly linked to said first computing device and said second computing device.

5. The live ammunition shooting competition system of claim 1, wherein an account of said first shooter is automatically updated in response to said indicator indicating an end of said shooting competition.

6. The live ammunition shooting competition system of claim 5, wherein said updating of said account includes an updated win to loss ratio of said first shooter.

7. The live ammunition shooting competition system of claim 6, wherein said updating of said account further includes a type of firearm and a shooting time.

8. The live ammunition shooting competition system of claim 1, wherein said parameter is a distance to target.

9. The live ammunition shooting competition system of claim 1, wherein said parameter indicates that a distance to target of said first shooter and said second shooter is disparate.

10. The live ammunition shooting competition system of claim 9, wherein said first computing device is a mobile phone that includes machine readable instructions executable by a processor.

11. The live ammunition shooting competition of claim 10, wherein said machine readable instructions are configured to determine a suggested parameter for said shooting competition.

12. The live ammunition shooting competition system of claim 1, wherein said first finish line target and said second finish line target are collectively configured such that each of said first finish line target and said second finish line target falls when any one of said first finish line target and said second finish line target is struck.

13. The live ammunition shooting competition system of claim 1, wherein said indicator is an audible indicator.

14. A live ammunition shooting competition system, comprising:

an elevated target stand comprising a first set of targets configured to be targeted by a first shooter and a second set of targets configured to be targeted by a second shooter, said first set of targets comprising a plurality of first targets and a first finish line target, said second set of targets comprising a plurality of second targets and a second finish line target, said first set of targets and said second set of targets being arranged such that said first shooter can view a shooting progress of said second shooter as said first shooter shoots at said first set of targets and said second shooter can view a shooting progress of said first shooter as said second shooter shoots at said second set of targets; and a first computing device associated with said first shooter and a second computing device associated with said second shooter, each of said first computing device and said second computing device configured to allow for a selection of a parameter of said shooting competition;

wherein;

said first finish line target and said second finish line target are collectively configured such that each of said first finish line target and said second finish line target falls when any one of said first finish line target and said second finish line target is struck; and said parameter is selected automatically by one of said first computing device and said second computing device based on a comparison of a skill of said first shooter and a skill of said second shooter.

15. The live ammunition shooting competition system of claim 14, further comprising a first identifier for said first shooter and a second identifier for said second shooter, each of said first identifier and said second identifier being configured to be machine readable.

16. The live ammunition shooting competition system of claim 15, wherein said first identifier is disposed on a wearable device.

17. The live ammunition shooting competition system of claim 14, wherein said parameter is a distance to target.

18. A shooting competition system, comprising:

a physical target area comprising a first set of targets assigned to a first shooter and a second set of targets assigned to a second shooter, said first set of targets comprising a plurality of first targets and a first finish line target, said second set of targets comprising a plurality of second targets and a second finish line target, said first set of targets and said second set of targets being arranged such that said first shooter can view a shooting progress of said second shooter as said first shooter shoots at said first set of targets and said second shooter can view a shooting progress of said first shooter as said second shooter shoots at said second set of targets; and a first computing device associated with said first shooter and a second computing device associated with said second shooter, each of said first computing device and said second computing device configured to allow said first shooter and said second shooter to challenge shooters to a shooting competition and to select a plurality of parameters for said shooting competition;

wherein;

each of said first computing device and said second computing device is configured to be automatically updated at an end of said shooting competition;

said plurality of parameters are selected automatically by one of said first computing device and said second computing device based on a comparison of a skill of said first shooter and a skill of said second shooter; and said plurality of parameters include a match rule set of the shooting competition, the shooting apparatus available for use in the shooting competition, distance from the first shooter to the first set of targets, and distance from the second shooter to the second set of targets.

19. The shooting competition system of claim 18, further comprising a referee computing device.

* * * * *